United States Patent [19]

Abascal

[11] 4,340,209

[45] Jul. 20, 1982

[54] ADJUSTABLE TUYERE

[75] Inventor: David J. Abascal, Riverside, Calif.

[73] Assignee: Kaiser Steel Corporation, Oakland, Calif.

[21] Appl. No.: 253,572

[22] Filed: Apr. 13, 1981

[51] Int. Cl.[3] ..... C21B 7/16

[52] U.S. Cl. ..... 266/266; 266/47; 266/270

[58] Field of Search ..... 266/265, 266, 267, 268, 266/269, 270, 47

[56] References Cited

U.S. PATENT DOCUMENTS 296,225 4/1884 Schulze-Berge ..... 266/266

4,171,798 10/1979 Vietorisz ..... 266/266

FOREIGN PATENT DOCUMENTS 528066 6/1931 Fed. Rep. of Germany ..... 266/266

*Primary Examiner*—M. J. Andrews

*Attorney, Agent, or Firm*—James E. Toomey; James A. LaBarre

[57] ABSTRACT

A tuyere for use in a blast furnace which includes choke means for adjusting the orifice of the tuyere to accomodate varying blast volumes. The choke fits into the tuyere and is adapted to move forward and backward as required by the blast.

4 Claims, 7 Drawing Figures

ADJUSTABLE TUYERE

This invention relates to the design of a modified tuyere for use in a blast furnace.

Tuyeres are distributed symmetrically about the upper circumference of the hearth of a blast furnace just below the bosh. The function of the tuyere is to provide passages for the blast of hot air and like gases which are blown into the furnace to superheat the interior thereof and aid in melting the metallic iron of the furnace charge. The internal passages of the tuyere, as well as the tuyere itself, may be of a constant diameter, but generally taper towards the nose end of the tuyere to assist the nozzle effect of the tuyere.

The wind velocity of the gases through the tuyere depends on the size of the blast furnace, the amount of furnace charge and the temperature at which the furnace is to be operated. A change in the wind velocity to be employed in the operation of a given furnace requires a change in the size of the passage in the tuyeres. To make such a change it is usually necessary to remove the tuyeres and replace them with another set of tuyeres of the required size. Such changes are time-consuming and expensive because they take several hours and require considerable labor. The present invention is concerned with over-coming the above disadvantages by altering the size of the tuyere passages with removal of the tuyeres.

Prior art proposals for modifying the size of the tuyere passages have not been satisfactory. It was suggested to employ transversally moveable plates, cooperating with damper plates for varying the inlet and outlet area of the tuyere. An outlet control similar to that suggested is disclosed in U.S. Pat. No. 296,255 wherein a water cooled gate is vertically moveable to block the flow of blast gas to varying degrees depending on the position of the gate in relation to the tuyere mouth. Inserts have been suggested for placement inside the tuyere nose to reduce the cross-sectional area of the tuyere mouth, the insert being knocked out by a rod inserted through the peephole when it is desired to increase that area. Such a system is disclosed in U.S. Pat. No. 2,087,842. It has been proposed to provide an apparatus comprising a water cooled ring disposed within and coaxially of a conical tuyere, the outside diameter of the ring being equal to the smallest internal diameter of the conical nozzle, the tuyere mouth. Such an apparatus is disclosed in U.S. Pat. No. 636,239. As mentioned, it has also been proposed to control the blast flow velocity as it leaves the tuyere mouth. Specifically, such a method is accomplished by deflection means extending beyond the tuyere mouth into the blast furnace hearth. Apparatus to effect this method is disclosed in United Kingdom Pat. No. 400,793. And, there is a "streamlined" body mentioned in the French Pat. No. 1,009,336 which body is a rigidly mounted vaporized employed to add atomized water droplets to the blast fluid current; it is positioned inside of a tuyere, but it is not used for varying blast jet velocities.

U.S. Pat. No. 2,087,842 is to reduce the size of the tuyere opening at the nose by inserting a frangible plug or bushing into the nose. The bushing has an open passage and serves as an orifice reducer. U.S. Pat. No. 22,111 shows the use of a pair of throttle plugs for constricting the wind passage on tuyeres as used by blacksmiths. The conditions in a blacksmith shop are of an entirely different kind than those in a blast furnace. U.S. Pat. No. 1,388,700 is to a tuyere for use under the hearth of a smith's forge which provides for an upward blast of air through a tuyere opening that is adjustable in size.

U.S. Pat. No. 3,188,070 and U.S. Pat. No. 4,171,798 show other devices for adjusting the flow of air through a tuyere by constricting or otherwise modifying the flow pattern of air through the nose portion of a tuyere. They are also complicated and far more expensive arrangements than the present invention.

SUMMARY OF THE INVENTION

This invention is directed to a modified blast furnace tuyere construction where the interior passage of the tuyere through which the hot blast passes is recessed in one arcuate area thereof, preferably in the upper region of the passage. The choke means is arranged within the tuyere and has a generally flat longitudinal cross-section conforming in contour to the recessed arcuate portion of the passage.

The choke may be moved forward to reduce the diameter of the tuyere orifice or can be otherwise adjusted to widen the orifice by retracting the choke to its original position wherein it nests in the recess so that the passage and orifice are at their widest diameters. Means are provided for adjusting the choke to its forward and retracted positions as desired. Both the choke and the tuyere have pipes and hollow channel portions for introduction of cooling liquids to maintain them at operative temperatures.

A more complete understanding of the invention can be had by reference to the accompanying drawings and detailed description.

DRAWINGS

In the drawings, FIG. 1 is a cross-section of a typical tuyere showing the generally uniform internal passage thereof and omitting any showing of the water-cooled walls thereof;

Figure 1:
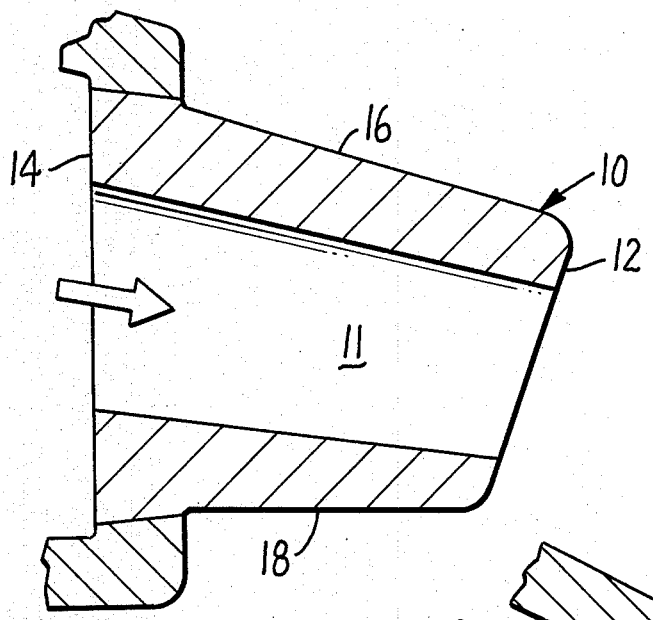
PRIOR ART FIG. 1.

In the drawings FIG. 1 is a cross-section of a conventional cast tuyere 10 (with the cooling passages not shown). Internal passage 11 runs from butt end 14 to nose 12 of the tuyere. Passage 11 is of generally uniform diameter at given points along its length and preferably has a slight taper toward nose 10 to provide a nozzle effect. Tuyere 10 is made of copper or copper alloys to facilitate the rather rapid water cooling of the tuyere which is subjected to the high temperatures of the furnace. In use nose 10 may project beyond the furnace wall (not shown) into the area adjacent the furnace reaction zone. The body of the tuyere is otherwise embedded or implaced in the furnace walls so that top wall area 16 and bottom wall area 18 of tuyere 10 are well insulated and protected by appropriate refractory wall materials.

Figure 6:
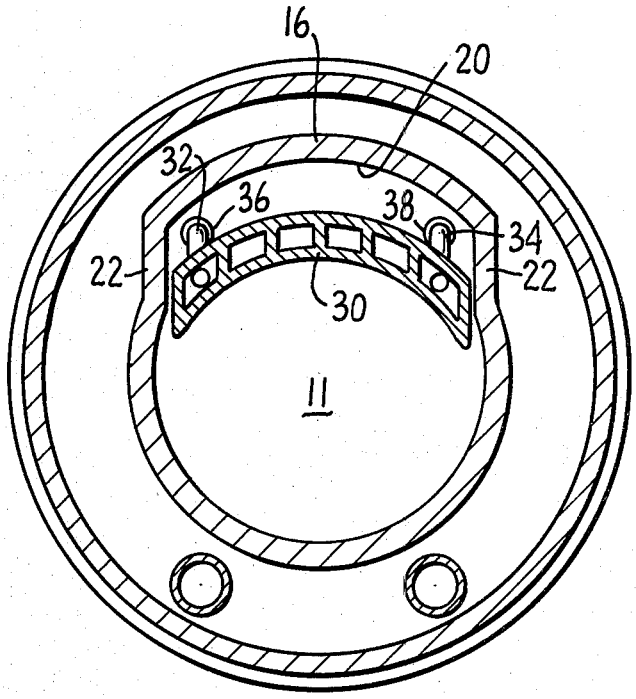
FIG. 6 is a sectional view taken along lines 6—6 of FIG. 2B.

In the modified tuyere of this invention a section of internal passage 11 in the nature of a segment is recessed, preferably in top wall area 16, to provide an arc shaped slot or crevice 20. To form recess 20 a segment is in effect cut away from passage 11 at a point spaced from nose 12 and extending longitudinally back towards butt 14. The top wall of recess 20 has a contour generally conforming to that of passage 11 except for its greater radius than that of passage 11. Advantageously the walls 22 of recess 20 are vertical (FIG. 6). The arcuate recess 20 is elongated and is substantially longer than it is thick and is tapered in the direction of nose 12, and must be large enough to accommodate choke 30 described below.

Figure 4:
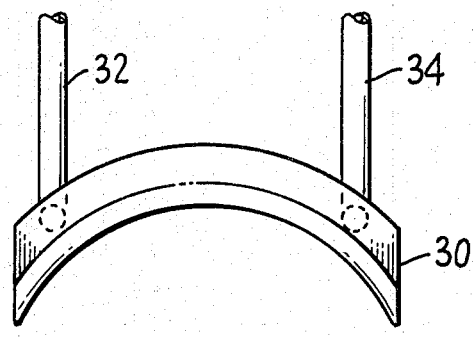
FIG. 4 is a fragmentary view of the choke member taken along line 4—4 of FIG. 3.

Choke 30 is an arcuate shaped device (FIG. 4) which not only has dimensions sufficient to nest within slot or recess 20 when retracted so that passage 11 conforms substantially to a conventional tuyere passage (see FIG. 1), but it must also have a contour and be of sufficient length, width and thickness to provide a nozzle effect when moved forward towards nose 12 by reducing the size of passage 11. FIG. 4 shows the arced contour of choke 30.

Figure 2A:
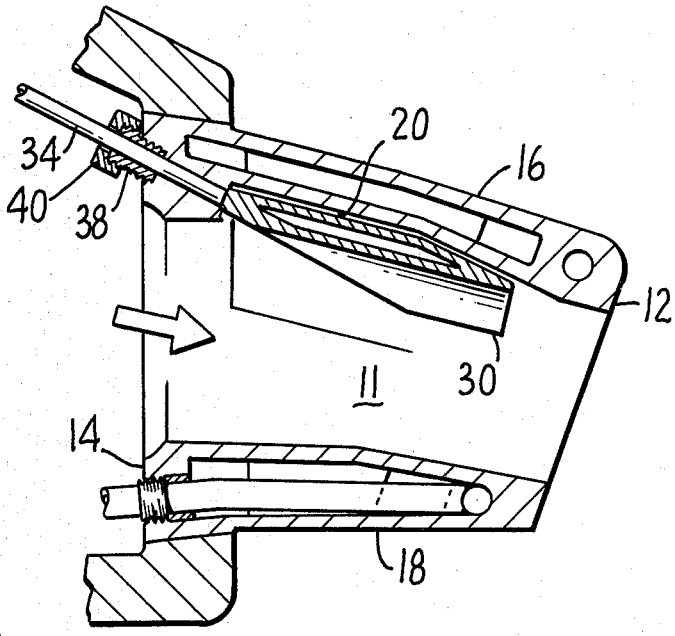
FIG. 2A is a sectional view of the modified tuyere of this invention showing the choke member in place.
Figure 2B:
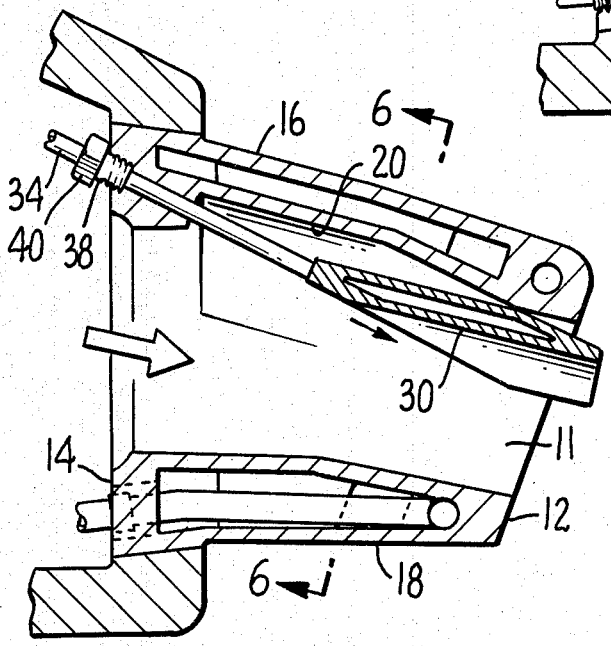
FIG. 2B is a sectional view of the modified tuyere of the invention showing the choke member moved forward to reduce the size of the tuyere orifice.
Figure 3:
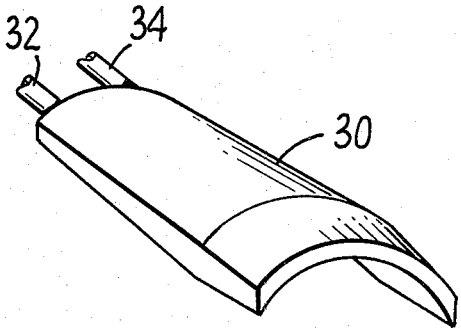
FIG. 3 is a perspective view of the choke member.
Figure 5:
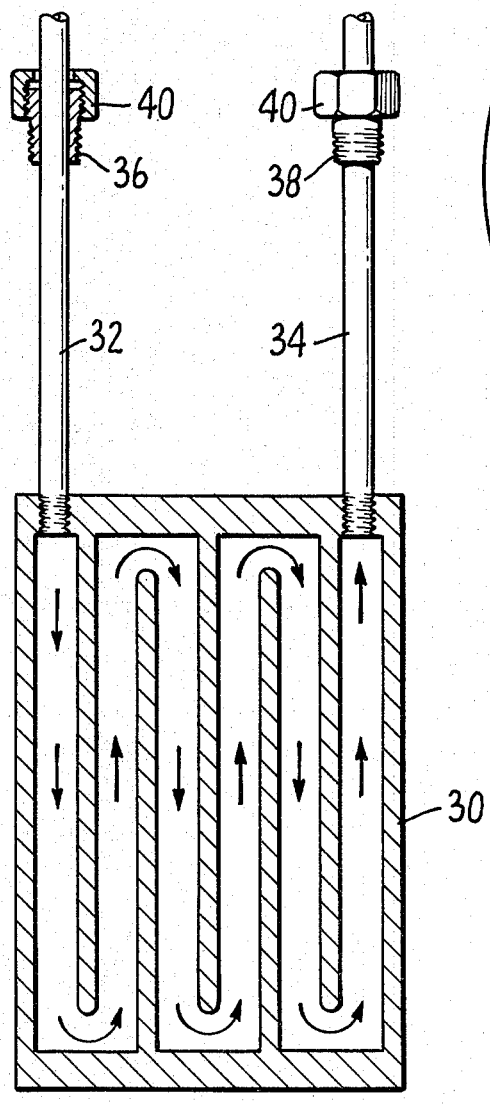
FIG. 5 is a view in section of part of the choke showing the internal structure thereof.

Choke 30 has internal passages for the circulation of cooling water. In the present invention longitudinally extending copper pipes 32 and 34 are attached to the end of choke 30. The pipes serve the dual function of feeding and discharging cooling water into and out of choke 30 and of moving the choke forward and backward. Pipes 32 and 34 are arranged to slide within sleeves 36 and 38, see FIG. 5 wherein the sleeves are shown at right angles to the arrangement of FIGS. 2A and 2B.

The choke may be moved forward to adjust the size of the opening of passage 11 at nose 12 to accomodate the wind velocity of the blast to be injected into the furnace through the tuyeres. Pipes 32 and 34 are calibrated to adjust the nose opening to the required velocity. Adapters 40 are provided outside of the furnace wall and can be fastened to pipes 32 and 34 in the proper positions for a given set of operating conditions.

Normally tuyere 10 has a fixed orifice and the size of the orifice at nose 12 may range from seven to four inches in diameter. Tuyeres of differing size are interchanged with changing production levels in the blast furnace. These changes are accomplished by shutting down the furnace and substituting tuyeres of different diameter according to the pressure of the required blast. Such shutdowns are expensive and time consuming. They generally take between eight to ten hours for a blast furnace which may utilize sixteen to twenty tuyeres.

The modified tuyere of the present invention allows the changing of the tuyere diameter without shutting down the blast furnace or changing the tuyeres. It is a simple operation to slide the horizontally disposed choke forward to decrease the orifice diameter at the tuyere nose as required by the blast to be passed through it. In like manner the choke may be returned to its retracted position to increase the diameter of the tuyere orifice. This avoids the cumbersome and time-consuming shutdown that would otherwise be required.

The tuyere of the invention is not to be limited to any sspecific size of blast furnace or to any given range of wind velocities. For example, it is useful in a furnace of 16 to 20 tuyeres operated at a wind velocity ranging from 55,000 to 110,000 cfm or it can be utilized in larger blast furnaces having 36 to 40 tuyeres with a wind velocity within the range of 225,000 to 260,000 cfm.

Thus, changes may be made in the embodiment disclosed herein without departing from the spirit of the invention or the scope of the appended claims.

I claim:

1. A blast furnace tuyere assembly comprising, a tuyere of cast metal of high heat conductivity copper having communicating passages therein for circulating cooling liquids throughout the cast body, said tuyere having a generally frusto-conical shape and being adapted to be located within the walls of a blast furnace, said tuyere having a generally uniform internal diameter for the flow of hot blast gases there through except for a recessed portion in one arcuate area thereof which recessed out portion extends along the length of said tuyere, choke means having a generally flat longitudinal cross section conforming in contour to said recessed arcuate portion, and which when emplaced therein provides an internal passage of generally uniform diameter, said choke means being adjustable to move forward from said emplaced position, and having sufficient cross-section to narrow the width of the orifice diameter of said tuyere as it moves into the forward position.

2. The tuyere assembly of claim 1 wherein said choke means may be moved forward and retracted to adjust for changing operating conditions within said blast furnace.

3. The choke member of claim 1 including adjustable pipes entering the rear section of said tuyere and in communication with said flat emplaced portion thereof.

4. The tuyere assembly of claim 1 wherein said choke member comprises a flat elongated hollow portion having passages for the circulation of fluid, and a pair of pipes connected to the rear end of said emplaced portion and having means for moving said emplaced portion forward and backward and being so connected that fluids may be circulated through said pipes and into said portion.

* * * * *